US006263972B1

(12) United States Patent
Richard et al.

(10) Patent No.: US 6,263,972 B1
(45) Date of Patent: Jul. 24, 2001

(54) COILED TUBING SCREEN AND METHOD OF WELL COMPLETION

(75) Inventors: Bennett M. Richard, Aberdeen (GB); Benn A. Voll, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/291,407

(22) Filed: Apr. 13, 1999

Related U.S. Application Data

(60) Provisional application No. 60/081,711, filed on Apr. 14, 1998.

(51) Int. Cl.[7] ..... E03B 3/18; E21B 43/08; E21B 43/10

(52) U.S. Cl. ..... 166/381; 166/230; 166/233

(58) Field of Search ..... 166/51, 228, 230, 166/233, 317, 205

(56) References Cited

U.S. PATENT DOCUMENTS

| | | | | |
|---|---|---|---|---|
| 602,547 | | 4/1898 | Titus | 166/278 |
| 2,804,926 | | 3/1957 | Zublin | 166/50 |
| 3,099,318 | | 7/1963 | Miller et al. | 166/227 |
| 3,353,599 | * | 11/1967 | Swift | 166/278 |
| 3,482,629 | | 12/1969 | Suman, Jr. | 166/255 |
| 4,484,626 | | 11/1984 | Kerfoot et al. | 166/191 |
| 4,976,322 | | 12/1990 | Abdrakhmanov et al. | 175/57 |
| 5,083,608 | | 1/1992 | Abdrakhmanov et al. | 166/55 |
| 5,119,661 | | 6/1992 | Abdrakhmanov et al. | 72/278 |
| 5,310,000 | | 5/1994 | Arterbury et al. | 166/296 |
| 5,366,012 | | 11/1994 | Lohbeck | 166/277 |
| 5,413,176 | | 5/1995 | Restarick | 166/277 |
| 5,667,011 | | 9/1997 | Gill et al. | 166/295 |
| 5,901,789 | * | 5/1999 | Donnelly et al. | 166/381 |
| 5,979,551 | * | 11/1999 | Uban et al. | 166/233 |

FOREIGN PATENT DOCUMENTS

| | | |
|---|---|---|
| WO 97/17524 | 5/1997 | (WO) . |
| WO 98/49423 | 11/1998 | (WO) . |

OTHER PUBLICATIONS

Porex Technologies, information on plastic materials, 10 pages, 1989–1990.
Perforated Tubes, Inc., brochure, 4 pages, date unknown.
Conwed Plastics, brochure and information, 11 pages, 1991–1993.

* cited by examiner

*Primary Examiner*—David Bagnell
*Assistant Examiner*—Jennifer M Hawkins
(74) *Attorney, Agent, or Firm*—Duane, Morris & Heckscher LLP

(57) ABSTRACT

The present invention allows a well to be produced through a screen without the need for a gravel pack. This is accomplished by the placement of an expandable screen that can move radially outwardly when placed at the desired location against the wellbore and be porous enough with sufficient open area to allow production from the formation. The screen is placed in the desired location by using coiled tubing which can be preperforated for a support for the screen. The screen is protected during delivery to the desired location in the wellbore by providing a disposable or removable outer cover which can be disposed of after proper location on the screen in the wellbore.

18 Claims, 1 Drawing Sheet

COILED TUBING SCREEN AND METHOD OF WELL COMPLETION

This application claims the benefit of U.S. Provisional Application No. 60/081,711 filed Apr. 14, 1998.

FIELD OF THE INVENTION

The field of this invention relates to downhole screens preferably delivered on coiled tubing where the tubing can also be expanded against the screen to push it against the wellbore.

BACKGROUND OF THE INVENTION

In typical completions in the past, metallic screens have been inserted on rigid or coiled tubing into a zone in the wellbore for production. Prior to producing the zone, sand particles were delivered outside the screen in a technique known as gravel packing. Screens have also been used that come prepacked with a sand layer as an alternative to the traditional gravel packing techniques or to be used in conjunction with the placement of sand outside the screen. The gravel packing procedures especially in horizontal completions left uncertainties as to whether the sand had been sufficiently distributed uniformly in the annular space so as to provide an effective gravel pack. Additionally, the gravel packing procedure took valuable time to accomplish and required the use of surface equipment to handle the material for placement in the wellbore. Another disadvantage of traditional gravel packing procedures is that an annular space around the screen had to be left so that the gravel could be placed there. The end result was the inside diameter within the screen was necessarily small to allow for the presence of the annular space. This constriction in size could also adversely affect the production of the formation to the surface.

In using certain drilling techniques, particularly in unconsolidated formations, the drilling mud would form a barrier adjacent the wellbore which cause subsequent plugging when the production began, even with screens and gravel packs being deployed.

A more ideal situation for producing a formation is to leave the wellbore in its drilled state so as to create the least amount of disturbance to the formation which has just been drilled. Traditional techniques leaving an annular gap which would be gravel packed, further involved risks of damaging the formation in the gravel packing process, such as when situations occurred that would allow fluid to convey the gravel to also apply hydraulic forces on the formation as well as incompatibilities between the formation and the fluids used to convey the gravel.

SUMMARY OF THE INVENTION

One of the objects of the present invention is to allow a well to be produced through a screen without the need for a gravel pack. This objective is accomplished by the placement of an expandable screen that can move radially outwardly when placed at the desired location against the wellbore and be porous enough with sufficient open area to allow production from the formation. Another objective is to be able to easily place the screen in the desired location. This objective is met in one way by using coiled tubing which can be preperforated for a support for the screen. Another objective is to protect the screen during delivery to the desired location in the wellbore by a providing a disposable or removable outer cover which can be disposed of after proper location of the screen in the wellbore. These and other objectives and the manner in which the apparatus and method accomplishes the objectives are further described below in the description of the preferred embodiment.

DETAILED DESCRIPTION OF THE PREFERRED EMBODIMENT

Figure 1:
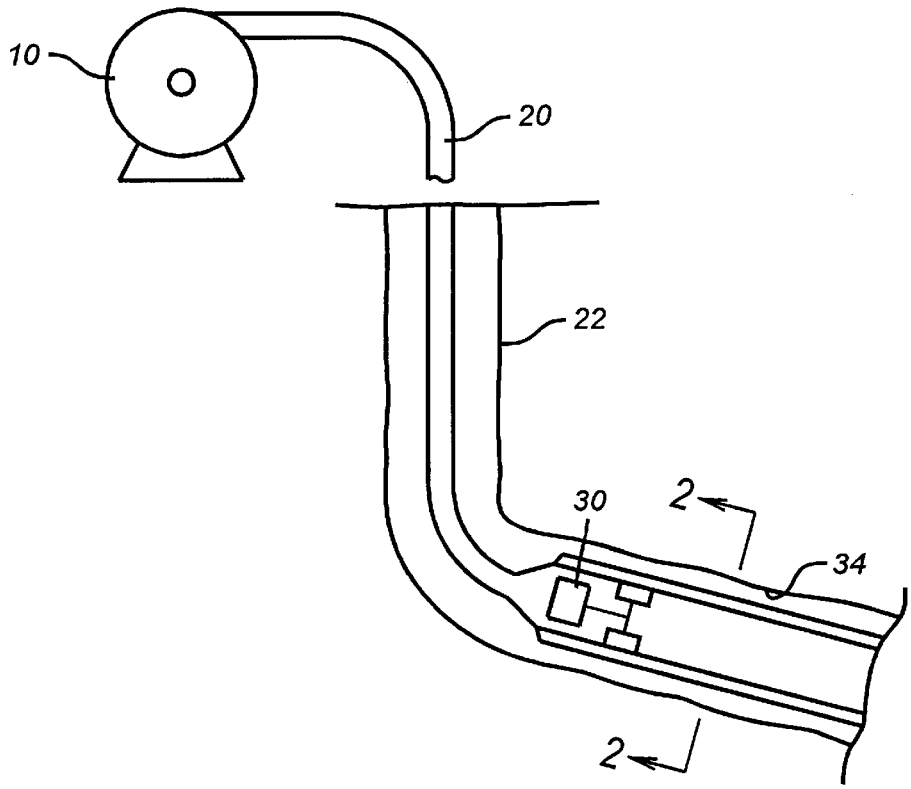
FIG. 1 is a sectional view of a deviated wellbore showing the apparatus expanded against the wellbore.
Figure 4:
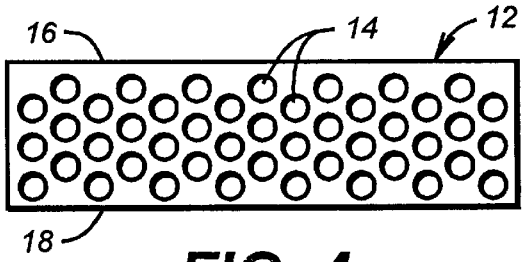
FIG. 4 is a segment which can be rolled longitudinally or spirally into flexible tubing which gives underlying support to the filter or media.

The preferred embodiment is illustrated in operation in FIG. 1. A coiled tubing reel 10 carries a continuous length of tubing 20, at least a portion of which is preferably made from a perforated material as shown in FIG. 4. As seen in FIG. 4, segment 12 has a plurality of perforations 14 which can be arranged in any order either random or in repeating pattern. The segment 12 can be punched for the holes 14 or the holes 14 can be placed there in any other known technique and in any order. The desirable goal is to have approximately a 30 or 40 percent open area when the segment 12 is rolled into a tubular shape. The segment 12 can be rolled longitudinally so that edges 16 and 18 are brought together to make a longitudinal seam which is welded or otherwise closed up. Alternatively, the segment 12 can be spirally wound so that edges 16 and 18 come together in a continuous spiral seam, with the advantage in spiral winding being that a particular outside diameter of a tubular configuration can be obtained with any given width of segment 12. This should be compared to rolling the segment 12 into a tube where its width determines the diameter of the tube that is formed when edges 16 and 18 are aligned and joined in a technique well known in the art.

The openings or holes 14 can be put on the tubing made from segment 12 for only a portion of the coiled tubing string 20. The segment 12 can be as long as the finished coiled length of the tubing 20 with openings 14 placed at the desired locations. Using conventional surface equipment and reel 10, the flexible tubing 20 can be quickly run into the wellbore 22 to place the perforated segment or segments at the desired locations.

Figure 2:
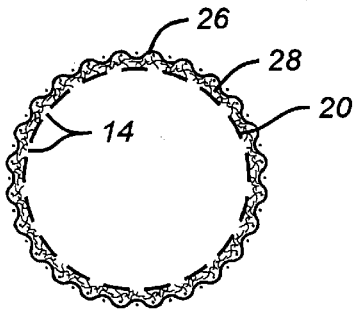
FIG. 2 is the section view along lines 2—2 of FIG. 1.
Figure 3:
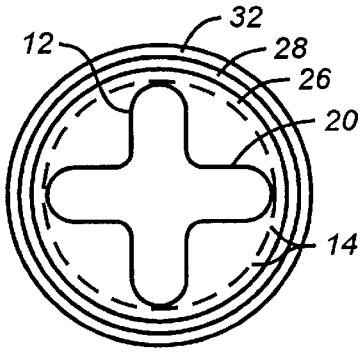
FIG. 3 is the section view of FIG. 2 shown before expansion of the inner tube against the filtering material.

FIG. 2 shows in section the tube 20 made from the segment or segments 12 along with openings 14. Wrapped around the openings 14 is an opened grid structure which can be made from metallic or composite or other nonmetallic materials. The purpose of the grid 26 is to provide a support off of tube 20 for the open cell filter media 28. In the preferred embodiment, the media 28 is made of Viton® and is an open cell structure akin to a sponge material such as is available from Mosites Rubber Company of Fort Worth, Tex. under Product No. 10292. The filter media 28 is in the form of a cylinder over grid 26 so that upon expansion, one portion of filter media 28 does not exhibit sliding movement with respect to another portion. The opening size can be made to suit. The significant feature of the filtering material 28 is that it is flexible. Thus, when the string 20 is preformed into a corrugated shape as shown in FIG. 3, by using known techniques such as pulling it through a die, the filter material 28 can then be applied over it as shown in FIG. 3. Thereafter, when the material 28 is properly positioned in the wellbore, a known expansion tool illustrated schematically as 30 in FIG. 1 can be inserted into the string 20 to take the initial shape shown in FIG. 3 and expand the string 20 under the filter material 28 to a rounded shape as shown in FIG. 2. As a result, the filter material which is flexible expands with the underlying tubular 20 as the shape of tubular 20 changes from that of FIG. 3 to that of FIG. 2.

A cover material 32 can overlay the filter material 28 for running in, so as to protect the filter material 28 from gauges or cuts during run-in. The material can be a thin sheet which snaps upon the slightest expansion of the corrugated tubular 20. It can be a elastomeric material that literally rips at the slightest expansion of the underlying corrugated tubular 20 as shown in FIG. 3. Other materials for the cover 32 can be employed without departing from the spirit of the invention or, in a particular application, the cover itself can be eliminated. A material which dissolves or is chemically attacked over time can also be employed as a cover 32 such that it will no longer be in the way when it is desired to put the well in production.

Significant expansions volumetrically can be obtained in changing the shape of the tubular 20 from the corrugated shape, such as shown for example in FIG. 3 to the rounded shape as shown in FIG. 2. While a particular four-lobe arrangement of the corrugated shape is shown in FIG. 3, other initial shapes are within the purview of the invention. The significant thing is that the underlying support structure which comprises the corrugated segment of the string 20, as shown in FIG. 3, is capable of volumetrically expanding as to bring the filter material 28 into contact with the wellbore as drilled. The initial corrugated shape also permits insertion in smaller wellbores. The initial shape does not have to be corrugated. It can be round and be expanded downhole.

This technique is particularly advantageous in underbalanced drilling where circulating mud is not used. In these situations, particularly where shale is encountered, the advantage of this type of drilling can be retained by use of the apparatus and method as described. The initial shape of the wellbore is retained by the assembly when the string 20 is expanded under the filter material 28 so as to push the filter material 28 up against the wellbore 22. In so doing, the formation can be allowed to flow through the filter material 28 without the presence of an annular space around the outside of the filter material. The traditional gravel packing is eliminated and the flow area within the tubular 20 after it has been expanded to a rounded shape is larger than it otherwise would have been using a traditional gravel pack which requires the annular space for the gravel necessitating a smaller inside diameter inside the screen.

It should be noted that it is within the purview of this invention to produce a formation through the use of a coiled tubing string such as 20 which is perforated with openings or holes 14. A tubing string 20 so perforated with openings 14 can be used in conjunction with traditional gravel pack techniques to produce a formation. In the preferred embodiment, the open cell filter material 28 preferably made of an elastic preferably elastomeric material such as Viton® is overlaid on the corrugated tubular 20 as shown in FIG. 3. The stretchable qualities of the filter material 28 allow its use in conjunction with an initially corrugated tube 20 as shown in FIG. 3 or a noncorrugated tube, and allow tube 20 to act as a sufficiently rigid support for the filter material 28 when expanded to its rounded form. The openings in material 28 do not expand substantially when the base pipe 20 expands. Additionally, open areas in tube 20 can be as high as 20 to 40 percent while still giving the tube 20 in the perforated area sufficient column strength to be advanced to the proper depth.

It is also within the purview of the invention to provide a filter material 28 over a coiled tubing string such as 20 which is perforated with holes 14 without initially corrugating the tube 20 under the filter material 28. This assembly can be expanded in an initial rounded state to push material 28 against the wellbore.

Various known techniques to expand the base pipe 20 can be used. The use of a flexible material for the filter material 28 gives predictable opening sizes and holds the formation in its natural state when in the expanded position, as shown in FIG. 2. Upon expansion, the tube material 20 with the filter material 28 around it act as a perforated casing for the purposes of production from the formation.

The reinforcing grid 26 can be a layer that overlays the tube 20 as shown in FIG. 2, or it can be a structural component within the filter material 28. The reinforcement 26 can be made from metallic and nonmetallic materials and is generally an open weave. However, other structures can be employed without departing from the spirit of the invention.

It is also within the purview of the invention to use an initially round cross section for the tube 20 under the filter material 28 and mechanically expand the combination against the wellbore. However, the preferred embodiment involves the use of a corrugated tube under filter 28 material so that greater volumetric expansions can occur underneath the filter material 28 to better position it against the wellbore.

In the preferred embodiment, the openings 14 are round. Rounded openings provide a better structural integrity of the tube after expansion than initial openings which are slotted. Using materials such as stainless steel 316L, yield strengths of 30,000 to 80,000 psi can be obtained.

It is also within the scope of the invention to provide a sufficient expansion force on the corrugated tube 20 to get it into the rounded position shown in FIG. 2 such that the filter 28 engages the wellbore with a residual force and, in certain conditions, pushes back the formation materials defining the wellbore to enlarge it.

The expansion techniques which are known can be used to change the configuration of the corrugated tube 20 under the filter material 28 to a rounded shape. These can include devices which employ a wedge which is pushed or pulled through the tubular or any other driving device which entails the use of rollers which can be actuated radially outwardly to initiate the expansion of the corrugated tubular as the driver advances.

Those skilled in the art will appreciate the advantages of the apparatus and method as described above. In lateral completions there is some uncertainly as to the distribution of the gravel around a screen. Additionally, the necessity of leaving an annular gap for placement of the gravel acts as a limitation on production from the zone in the wellbore. In certain applications involving unconsolidated shale formations, drilling with mud can create an impervious cake on the wellbore walls which will be detrimental to future production when used with traditional gravel packing techniques. Accordingly, since it is more advantageous to allow the formation to begin producing when it is as close to its natural state as possible, the concept of producing through coiled tubing with the apparatus and method as described greatly enhances the production possible from the formation. Accordingly, an open cell filtering material such as 28 which can be stretched is preferred in combination with an underlying coiled tubing material which can be expanded from the corrugated initial condition to a rounded final condition. The open cell filter material 28 can be pushed firmly against the formation where it can easily resist longitudinal flow due to the small pressure increments involved in flow in that direction. The opening size in the filter material 28 is predictable and the assembly can be protected for delivery to the desired location with the cover structure eliminated prior to or during the expansion of the filter material 28 with the underlying tube 20 below it. While various types of mechanical expansions of the underlying tube 20 from a corrugated state to a rounded state have been described, other techniques to push the filter material 28 against the wellbore while supporting it with an underlying perforated support pipe having a large open area, in the order of 20 to 40 percent, are also in the purview of the invention. The reinforcing layer which can be between the tube and the filter material 28, or within the filter material 28, prevents extrusion of the filter material 28 through the openings 14 in the base pipe or tube 20, as shown in FIG. 2.

The foregoing disclosure and description of the invention are illustrative and explanatory thereof, and various changes in the size, shape and materials, as well as in the details of the illustrated construction, may be made without departing from the spirit of the invention.

What is claimed is:

1. A wellbore completion tool assembly, comprising:

a perforated body made of an expandable material said perforations are non-slotted;

a stretchable filter assembly secured to said perforated body so as to cover the perforations in said body;

a tool acting on said body to expand it and said filter mounted around it without sliding movement of one portion of said filter over another portion of said filter to allow said filter to move toward the surface defining the wellbore.

2. The assembly of claim 1, wherein:

said expandable material is corrugated to facilitate insertion into the wellbore, whereupon said tool expands said corrugations to move said filter toward the surface defining the wellbore.

3. The assembly of claim 2, wherein:

said body assumes a rounded shape after expansion by said tool.

4. The assembly of claim 2, wherein:

said perforated body comprises a segment of a coiled tubing string.

5. The assembly of claim 4, further comprising:

a reinforcement between said body and said filter assembly to support said filter assembly in the area of said body perforations.

6. The assembly of claim 5, further comprising:

a protective cover for said filter assembly which is removable downhole.

7. The assembly of claim 1, further comprising:

a reinforcement between said body and said filter assembly to support said filter assembly in the area of said body perforations, said reinforcement expandable with said body and filter assembly.

8. The assembly of claim 1, wherein:

said segment has an open area in the range of up to about 40%.

9. The assembly of claim 1, wherein:

said segment is flexible.

10. The assembly of claim 1, wherein:

said segment is made from a flat member which is rolled into a tube with a sealed longitudinal joint.

11. The assembly of claim 1, wherein:

said segment is made from a flat member and rolled spirally to a desired diameter having its spiral seam sealed.

12. A well bore completion tool assembly, comprising:

a perforated body made of an expandable material;

a filter assembly mounted over said perforated body so as to cover the perforations in said body;

a tool acting on said body to expand it and said filter mounted around it to allow said filter to move toward the surface defining the well bore;

a protective cover mounted over said filter assembly which is removable down hole.

13. A method of well completion, comprising:

running in a tubular body with non-slotted perforations and a stretchable filter assembly secured to said body;

expanding the tubular body and the stretchable filter downhole without sliding movement of one portion of said filter with respect to another.

14. The method of claim 13, further comprising:

providing a protective covering over the filter assembly for run-in;

removing the protective covering downhole.

15. The method of claim 13, further comprising:

corrugating said tubular body;

altering said corrugating into a rounded shape by virtue of said expanding.

16. The method of claim 13, further comprising:

providing a support between said tubular body and said filter assembly.

17. The method of claim 13, further comprising:

providing an open area on said tubular body of up to about 40%.

18. The method of claim 13, further comprising:

corrugating said tubular body;

altering said corrugating into a rounded shape by virtue of said expanding.

* * * * *

US006263972C1

(12) EX PARTE REEXAMINATION CERTIFICATE (5415th)

United States Patent

Richard et al.

(10) Number: US 6,263,972 C1

(45) Certificate Issued: Jun. 20, 2006

(54) COILED TUBING SCREEN AND METHOD OF WELL COMPLETION

(75) Inventors: Bennett M. Richard, Aberdeen (GB); Benn A. Voll, Houston, TX (US)

(73) Assignee: Baker Hughes Incorporated, Houston, TX (US)

Reexamination Request:
No. 90/006,687, Jun. 30, 2003

Reexamination Certificate for:

| | |
|---|---|
| Patent No.: | **6,263,972** |
| Issued: | **Jul. 24, 2001** |
| Appl. No.: | **09/291,407** |
| Filed: | **Apr. 13, 1999** |

Related U.S. Application Data

(60) Provisional application No. 60/081,711, filed on Apr. 14, 1998.

(51) Int. Cl.

| | |
|---|---|
| ***E03B 3/18*** | (2006.01) |
| ***E21B 43/08*** | (2006.01) |
| ***E21B 43/10*** | (2006.01) |

(52) U.S. Cl. ..... 166/381; 166/230; 166/233

(58) Field of Classification Search ..... 166/381, 166/51, 228, 230, 233, 317, 205

See application file for complete search history.

(56) References Cited

U.S. PATENT DOCUMENTS

| | | | | | |
|---|---|---|---|---|---|
| 602,547 | A | * | 4/1898 | Titus | 166/278 |
| 2,804,926 | A | * | 9/1957 | Zublin | 166/50 |
| 2,812,025 | A | | 11/1957 | Teague et al. | |
| 3,047,065 | A | | 7/1962 | Vincent | |
| 3,099,318 | A | * | 7/1963 | Miller et al. | 166/227 |
| 3,107,727 | A | | 10/1963 | Howard | |
| 3,270,817 | A | | 9/1966 | Papaila | |
| 3,353,599 | A | * | 11/1967 | Swift | 166/278 |
| 3,482,629 | A | * | 12/1969 | Suman, Jr. | 166/255.1 |
| 4,484,626 | A | * | 11/1984 | Kerfoot et al. | 166/191 |
| 4,976,322 | A | * | 12/1990 | Abdrakhmanov et al. | 175/57 |
| 5,083,608 | A | * | 1/1992 | Abdrakhmanov et al. | 166/55 |
| 5,119,661 | A | * | 6/1992 | Abdrakhmanov et al. | 72/276 |
| 5,310,000 | A | * | 5/1994 | Arterbury et al. | 166/296 |
| 5,366,012 | A | * | 11/1994 | Lohbeck | 166/277 |
| 5,411,084 | A | | 5/1995 | Padden | |
| 5,413,176 | A | * | 5/1995 | Restarick | 166/277 |
| 5,622,211 | A | | 4/1997 | Martin et al. | |
| 5,664,628 | A | | 9/1997 | Koehler et al. | |
| 5,667,011 | A | * | 9/1997 | Gill et al. | 166/295 |
| 5,901,789 | A | * | 5/1999 | Donnelly et al. | 166/381 |
| 5,979,551 | A | * | 11/1999 | Uban et al. | 166/233 |
| 6,006,829 | A | | 12/1999 | Whitlock et al. | |
| 6,250,385 | B1 | | 6/2001 | Montaron | |
| 6,354,373 | B1 | | 3/2002 | Vercaemer et al. | |

FOREIGN PATENT DOCUMENTS

| | | | |
|---|---|---|---|
| SU | 1314021 A1 | | 3/1989 |
| WO | 97/17524 | * | 5/1997 |
| WO | WO 97/17526 | | 5/1997 |
| WO | 98/49423 | * | 11/1998 |
| WO | WO 99/23354 | | 5/1999 |

* cited by examiner

*Primary Examiner*—William Neuder

(57) ABSTRACT

The present invention allows a well to be produced through a screen without the need for a gravel pack. This is accomplished by the placement of an expandable screen that can move radially outwardly when placed at the desired location against the wellbore and be porous enough with sufficient open area to allow production from the formation. The screen is placed in the desired location by using coiled tubing which can be preperforated for a support for the screen. The screen is protected during delivery to the desired location in the wellbore by providing a disposable or removable outer cover which can be disposed of after proper location on the screen in the wellbore.

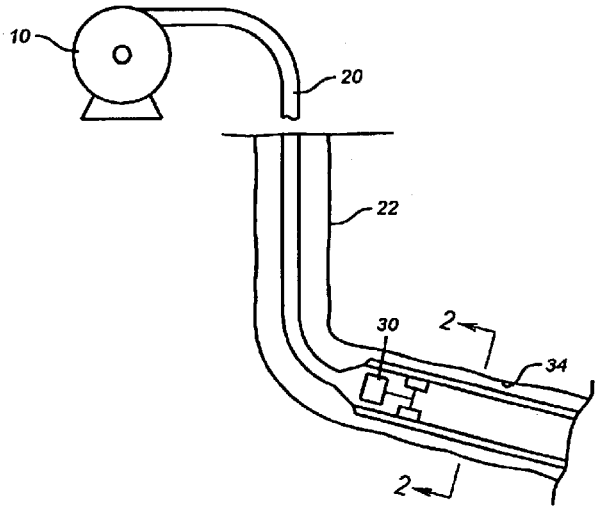

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–18 are cancelled.

* * * * *